US006309209B1

(12) United States Patent
Cacace

(10) Patent No.: US 6,309,209 B1
(45) Date of Patent: Oct. 30, 2001

(54) FLASH SUPPRESSOR FOR HOT WATER HEATER

(76) Inventor: Jeffrey Cacace, Two Southview Ct., Huntington, NY (US) 11743

( * ) Notice: Subject to any disclaimer, the term of this patent is extended or adjusted under 35 U.S.C. 154(b) by 0 days.

(21) Appl. No.: 09/528,813

(22) Filed: Mar. 20, 2000

(51) Int. Cl.[7] ..... F23D 14/82; F22B 37/36

(52) U.S. Cl. ..... 431/346; 126/201; 126/383.1; 122/19.2; 122/494; 220/694.1

(58) Field of Search ..... 431/346; 126/383.1, 126/376.1, 544, 299 C, 299 F, 214 D, 350.1, 42, 201, 198, 193; 122/13.01, 17.1, 19.2, 494; 220/694.1

(56) References Cited

U.S. PATENT DOCUMENTS 566,149 * 8/1896 Donaldson ..... 126/67
2,830,574 * 4/1958 Shafer ..... 126/350.1
2,833,615 * 5/1958 Kollgaard ..... 126/299 F
5,085,205 * 2/1992 Hall et al. ..... 122/17.1
5,542,407 * 8/1996 Hawkinson ..... 126/193
5,823,175 * 10/1998 Sweitzer et al. ..... 126/201
5,848,586 * 12/1998 Garms ..... 126/344
5,918,591 * 7/1999 Vollmar et al. ..... 122/13.01
5,967,138 * 10/1999 Cacace ..... 126/350.1
6,003,507 * 12/1999 Flick et al. ..... 126/515
6,029,615 * 2/2000 Terwilliger et al. ..... 122/494

FOREIGN PATENT DOCUMENTS 513 859 * 2/1921 (FR) .
2 031 577 -A * 4/1980 (GB) .

* cited by examiner

*Primary Examiner*—Ira S. Lazarus
*Assistant Examiner*—Josiah C. Cocks
(74) *Attorney, Agent, or Firm*—Collard & Roe, PC.

(57) ABSTRACT

A flash suppressor for surrounding a gas-fired appliance, comprising a barrier for forming an enclosure around a lower portion of the appliance. The barrier has an inside wall, an outside wall and a space between the inside and outside walls. The outside wall has at least one aperture for air to pass into the space. There is a filter disposed in the space for filtering fumes from outside the outside wall to prevent the fumes from reaching the appliance and igniting from a spark from the appliance. There is an outwardly extending flange surrounding a top edge of the barrier. The flange has an inside wall connected to the inside wall of the barrier, an outside wall connected to the outside wall of the barrier, and a space between the inside and outside walls that communicates with the space in the barrier. The flange has an open top, so that fumes travel through the filter and out the open top and are thus kept away from the flame in the appliance.

15 Claims, 4 Drawing Sheets

FLASH SUPPRESSOR FOR HOT WATER HEATER

BACKGROUND OF THE INVENTION

1. Field of the Invention

This invention relates to a protective covering for a gas-fueled appliance. In particular, the invention relates to a device for surrounding the lower periphery of an appliance such as a water heater or furnace, to prevent spills on the floor from contacting the appliance and to contain any explosions or fires resulting from the ignition of fumes by the heater's gas flame.

2. The Prior Art

Natural gas-fueled water heaters have become very common in households, due to the efficiency and low cost of natural gas. One problem that has developed as a result of these water heaters, however, is the danger of fire and explosion from fumes and/or spills contacting the gas flames at the bottom of the water heater. These explosions and fires can cause substantial property damage, injury to household occupants, and even death. One proposed solution has been to elevate the water heater approximately 18 inches off of the floor. The drawbacks of this solution are that often there is insufficient headroom to elevate the heater in a small, low basement, or that the required revisions to the pipe system connected to the heater make the elevation unfeasible and too expensive.

There have been attempts to construct shields to keep the fumes from spills from coming near the flame of the water heater one such device is disclosed in U.S. Pat. No. 5,918,591 to Vollmar et al. This device comprises a mounting strip and a shield mounted in the mounting strip to surround the water heater. The strip and shield are made of plastic. Another such device is shown in U.S. Pat. No. 5,967,138 to Cacace. This device comprises an aluminum collar that is held in place by two rings to hold it in place.

While these device are useful in preventing some explosions, they are not well equipped to handle all types of hazardous fumes.

SUMMARY OF THE INVENTION

It is therefore an object of the present invention to overcome the drawbacks of the prior art and to provide means for preventing explosions and fires resulting from the contact of all fumes or flammable liquids with the gas flames in water heaters.

It is another object of the invention to provide a means for preventing such fires and explosions without moving or changing the configuration of the water heater.

It is yet another object of the present invention to provide a means for preventing such fires and explosions that is easy to assemble, inexpensive and removable.

These and other objects and features of the present invention are accomplished by a flash suppressor for surrounding a gas-fired appliance, comprising a barrier that forms an enclosure around a lower portion of the appliance. The barrier has an inside wall, an outside wall and a space between the inside and outside walls. The outside wall has at least one aperture for air to pass into the space. There is a filter disposed in the space for filtering fumes from outside the outside wall to prevent the fumes from reaching the appliance and igniting from a spark from the appliance. The inside wall is preferably a thin piece of aluminum and the outside wall is preferably a thicker piece of steel. The inside wall is preferably a thin piece of aluminum and the outside wall is preferably a thicker piece of steel.

Typically, the appliance is a hot water heater or a gas furnace. If the appliance to be protected is a hot water heater, the barrier is round. If the appliance is a furnace, the barrier will be rectangular, to follow the shape of the appliance.

There is an outwardly extending flange surrounding a top edge of the barrier. The flange has an inside wall connected to the inside wall of the barrier, an outside wall connected to the outside wall of the barrier, and a space between the inside and outside walls that communicates with the space in the barrier. The flange is made of steel and has an open top, so that fumes travel through the filter by way of air currents caused by the heat given off by the water heater and out the open top and are thus kept away from the flame in the appliance. The flange having the open top is made of thicker steel to cool the fumes as they exit. The outward direction of the flange directs the filtered fumes away from the appliance. Preferably, the flange extends about 2½ inches out from the outside wall of the flash suppressor.

In use, the temperature difference between the thin aluminum inner wall and the thicker steel outer wall and flange causes a thermal air draft inside the flash suppressor, causing air to be sucked in from the outside and out through the opening in the flange.

The flash suppressor preferably has a base for supporting the barrier on the floor. The base has a flat bottom and two side walls that contact the inside and outside walls of the barrier to keep the barrier in place. This is particularly important if the barrier is made of two or more pieces that fit together to surround the appliance.

The filter is preferably a removable panel that contains activated granular carbon. The activated carbon removes 80–90% of the hydrocarbons from the fumes that could ignite when in contact with a spark from the appliance. The filter should be changed every year to prevent excess solids buildup and should be changed after every fume-creating spill near the flash suppressor.

To accommodate the filter between the inside and outside walls, the outside wall has a lower portion and an upper portion, with the lower portion being larger in circumference the upper portion. The outer wall has a horizontally oriented channel between the upper portion and lower portion to permit insertion and removal of the filter. The channel preferably has a cap removably positioned over it.

Preferably, the barrier is about eighteen inches in height and together with the flange measures about 20 inches in height. The filter is preferably about 12 inches in height. The width of the flash suppressor depends on the size of the appliance to be surrounded. Ideally, there is about a 3 inch gap between the appliance and the inside wall of the barrier all around. For example, if a water heater is 19 inches in width, the barrier would have an inside diameter of 25 inches. The space between the inside walls and the outside walls of the upper portion, between the filter and inside wall is preferably about ½ inch, which allows sufficient air flow through the barrier without it being too thick or too thin to cause the air draft to be too strong or too weak. If the draft is too strong, the filter may not work efficiently. If the draft is too weak, the current cannot draw the fumes fast enough to work properly.

The barrier is preferably made of at least two pieces that fit together around the appliance. The barrier is preferably made of galvanized steel. The ends of each piece are preferably capped. In this embodiment, the filter is also divided into at least two sections to fit within each piece of the barrier.

To maintain the width of the space between the inside and outside walls, there are a plurality of vertical ribs disposed between the inside and outside walls. Alternatively, other types of spacers or supports could also be used.

There is preferably a cover surrounding the flash suppressor and having exhaust and inlet openings to allow the fumes to be filtered.

The present invention is simple to manufacture and successfully prevents ignition of fumes that occur near a gas-fired appliance. It can be easily installed around existing appliances with no modification of the appliance needed.

BRIEF DESCRIPTION OF THE DRAWINGS

Other objects and features of the present invention will become apparent from the following detailed description considered in connection with the following drawings. It is to be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
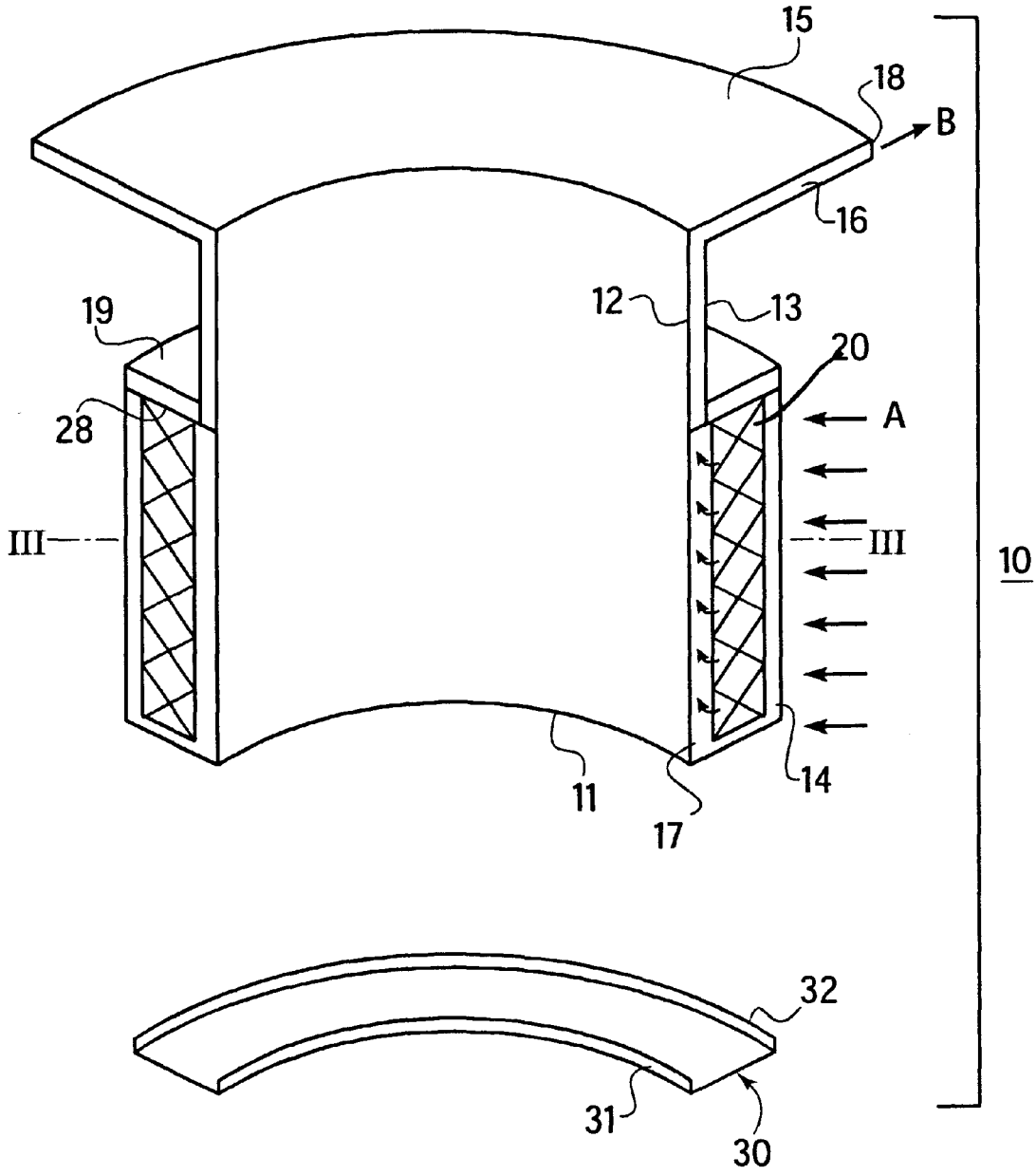
FIG. 1 is an exploded cross-sectional view of a section of the flash suppressor according to the invention.
Figure 2:
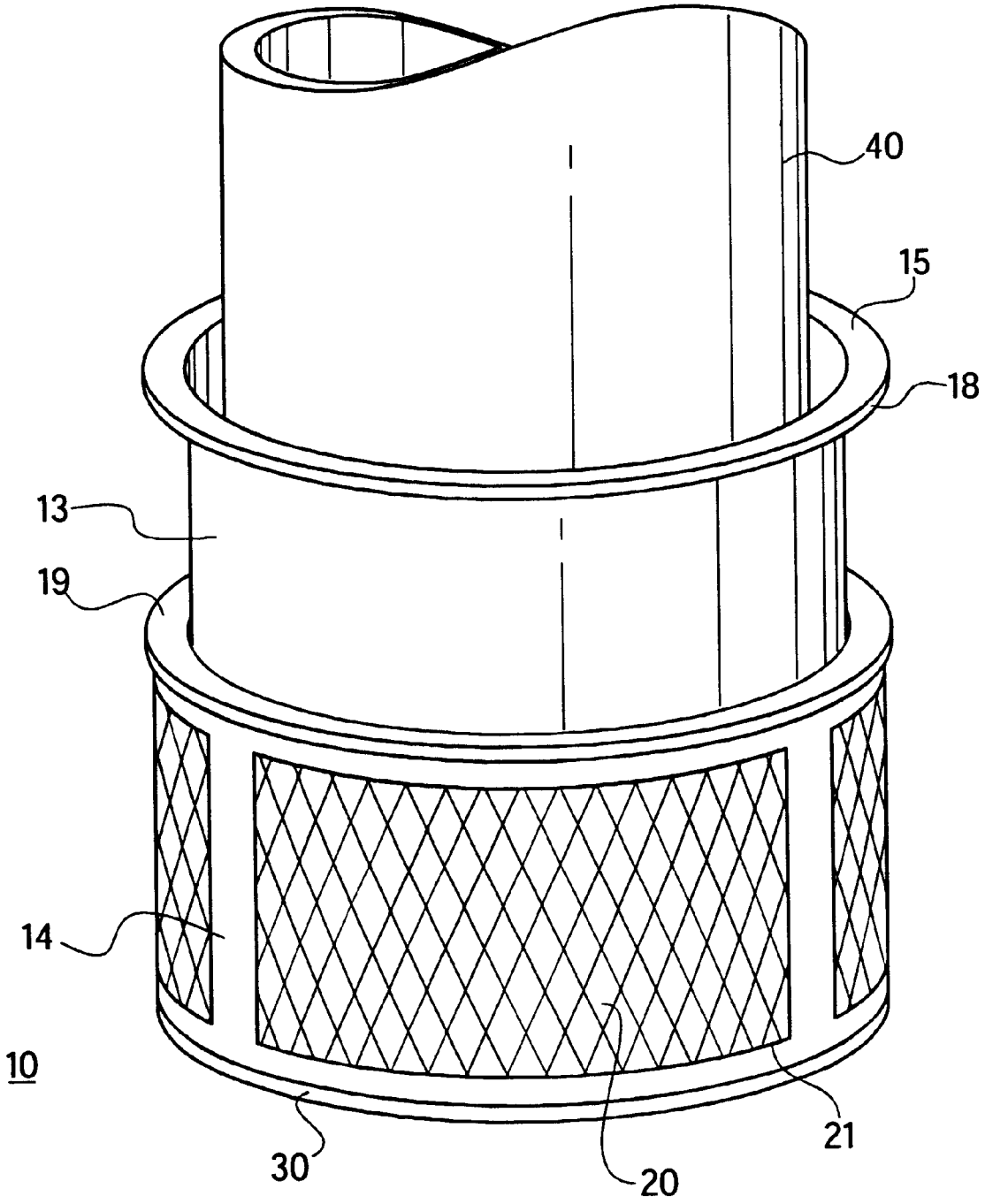
FIG. 2 is a perspective view of the flash suppressor as mounted around a hot water heater.

Turning now in detail to the drawings, FIGS. 1 and 2 show a flash suppressor 10 according to the invention. Flash suppressor 10 comprises a barrier 11 having an aluminum inside wall 12 and a steel outside wall 13 having a wider lower portion 14. There is a space 17 between inside wall 12 and outside wall 13 to allow air to flow through. A filter 20 is removably disposed in space 17 between inner wall 12 and lower portion 14. There is a steel flange 15 extending upward and outward from barrier 11. Flange 15 has an interior space 16 that communicates with space 17. Flange 15 has an open edge 18 to allow air and gases in space 16 to escape. Flange 15 may be a separate piece that is welded onto barrier 11 or it may be integrally formed with barrier 11.

Filter 20 is removably installed in space 17 by sliding it in between lower portion 14 and inside wall 11 through channel 28 and covering it by a cap 19 which extends around a channel that separates lower portion 14 from upper portion 13. Filter 20 preferably contains activated carbon to filter out flammable hydrocarbons in the surrounding air.

Barrier 11 sits on a base 30 having an inner wall 31 and an outer wall 32 to engage barrier 11 and support it on a surface such as the ground. In use, barrier 11 and base 30 can be in several pieces that are assembled around an appliance such as a hot water heater 40, shown in FIG. 2. The pieces can be attached to each other by any conventional fastening means, such as a male-female engagement, a latching mechanism, adhesives or any other suitable fastener. Each piece preferably has its ends covered by a cap to keep the filter in place.

So that fumes from the surrounding area can enter space 17 to reach filter 20, lower portion 14 has a plurality of large apertures 21. Gases and fumes from a spill or leak can pass through filter 20 via arrows A and enter spaces 17 and 16 and exit flange 15 through open edge 18 as shown by arrow B, at which point the fumes have been filtered and are harmless. The angle of flange 15 aims the fumes away from the appliance. The present invention keeps the fumes from contacting any open flame or sparks that may exist near the appliance. The thinner aluminum inside wall 12 becomes hotter than the thicker steel outside wall 13 and causes a thermal draft inside flash suppressor 10. This pulls air and fumes in from outside flash suppressor 10, to be filtered by filter 20. The filtered fumes are then sucked through flange 15 and out edge 18.

Figure 3:
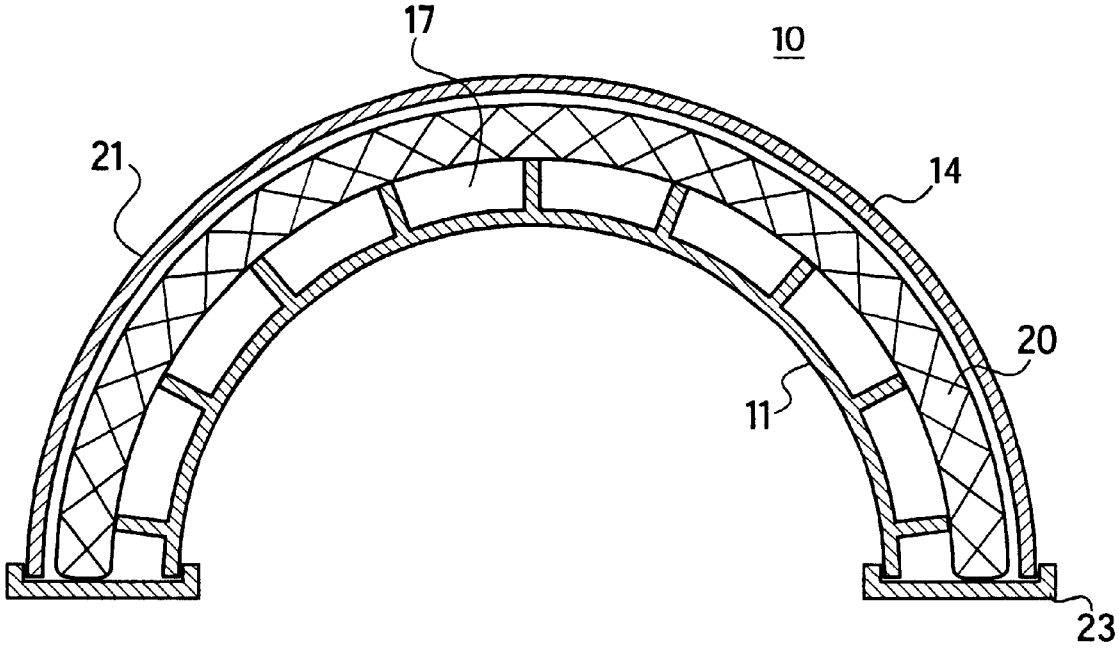
FIG. 3 is a top cross-sectional view along lines III—III of FIG. 1.

As shown in FIG. 3, there are a plurality of ribs 22 disposed around the interior of inside wall 12 to keep filter 20 in place and to add stability to barrier 11. There is also an end cap 23 disposed at the end of each piece of flash suppressor 10 to keep filter 20 in the proper position.

Figure 4:
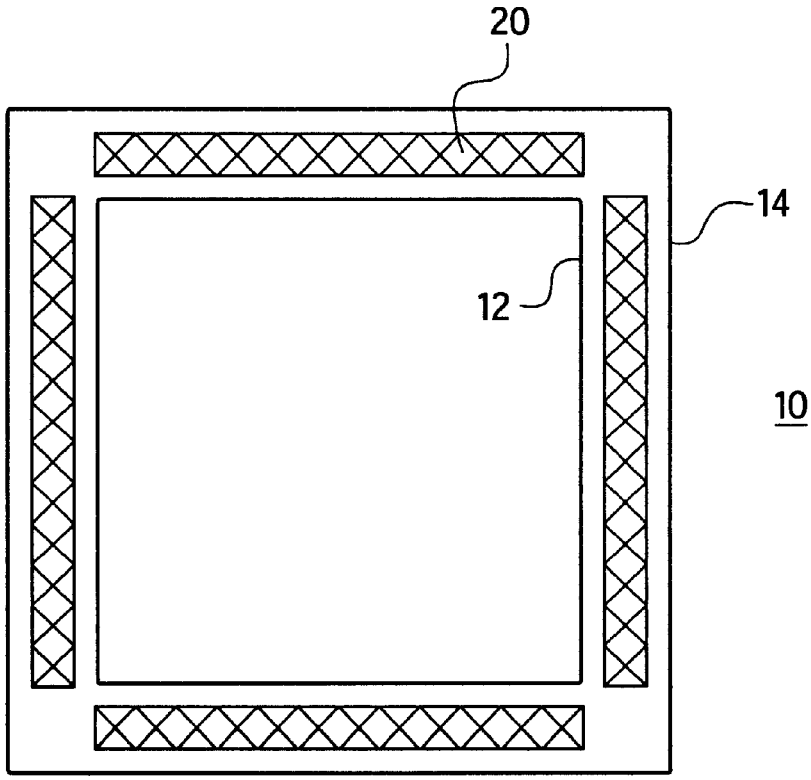
FIG. 4 is a top cross-sectional view of an alternative embodiment of the invention.

While a round water heater is shown in FIGS. 1–3, flash suppressor 10 can also be modified to be used with other appliances such as a gas furnace. In that case, only the shape and size need to be changed. For example, with a gas furnace, the flash suppressor 10 should be square as shown in FIG. 4 or rectangular to follow the shape of the appliance with a clearance of about 3 inches on all sides. Barrier 11 is preferably constructed of galvanized steel, but other materials could be used as well.

Figure 5:
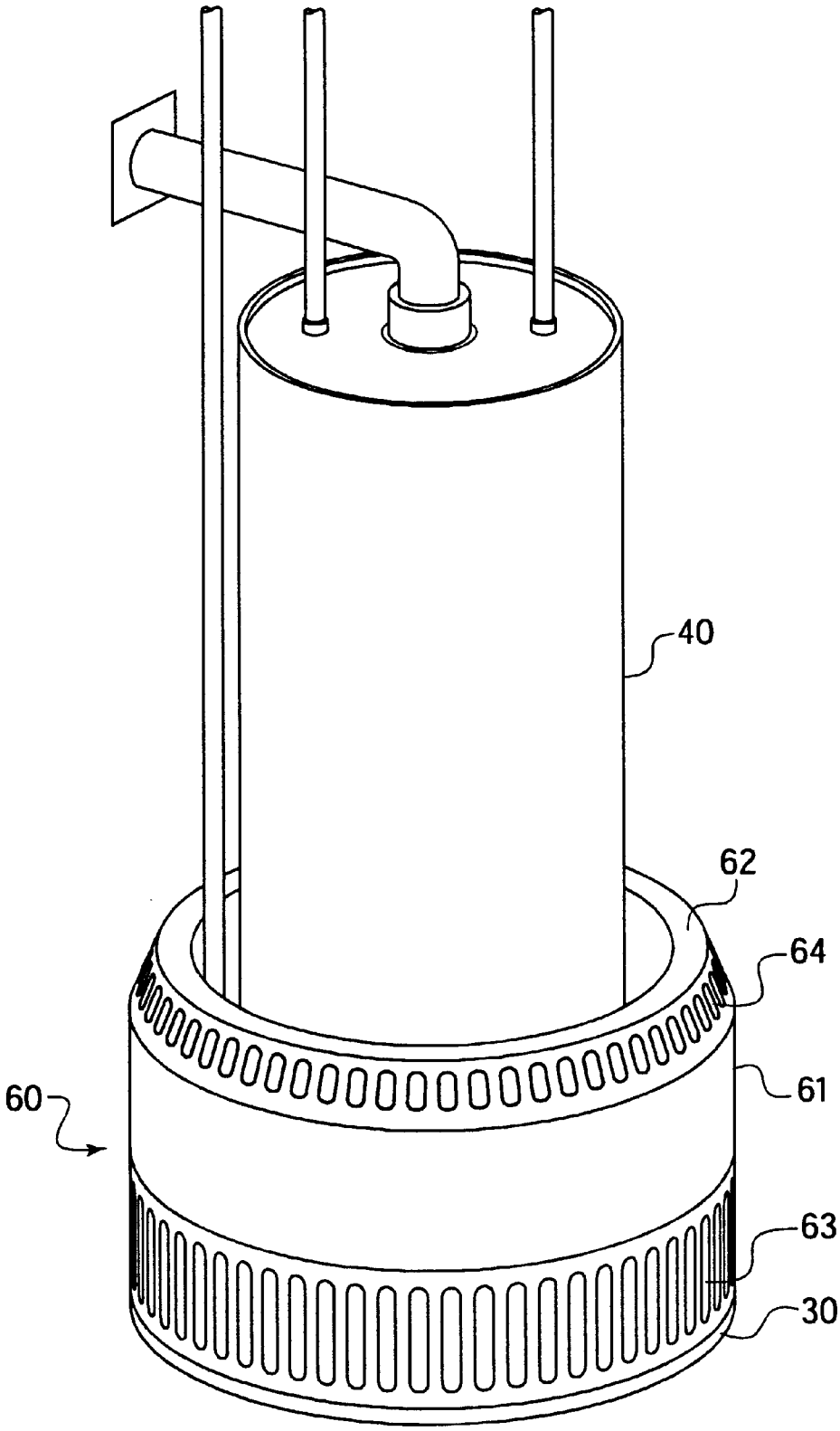
FIG. 5 is a perspective view of the flash suppressor having a cover according to the invention and surrounding a hot water heater.

FIG. 5 shows the flash suppressor surrounding a hot water heater 40. Here, there is a cover 60 covering the flash suppressor. Cover 60 sits on top of base 30 and has inlet openings 63 to let the fumes into the filter, and exhaust openings 64 to let the filtered fumes out from the flange. There is an inwardly extending lip 62 surrounding the top edge to further seal the flash suppressor.

Accordingly, while only a few embodiments of the present invention have been shown and described, it is obvious that many changes and modifications may be made thereunto without departing from the spirit and scope of the invention.

What is claimed is:

1. A flash suppressor for surrounding a gas-fired appliance, comprising:

a barrier for forming an enclosure around the appliance, said barrier having an inside wall, an outside wall and a space between said inside and outside walls and an open top, said outside wall having at least one aperture for air to pass through the outside wall into said space; and a filter disposed in said space;

wherein fumes near said outside wall enter the space through said at least one aperture, are filtered by said filter, and exit said space through said top opening to prevent the fumes from reaching the appliance.

2. The flash suppressor according to claim 1, further comprising an upwardly and outwardly extending flange surrounding a top edge of said barrier, said flange having an inside wall connected to the inside wall of the barrier, an outside wall connected to the outside wall of the barrier, a space between said inside and outside walls that communicates with the space in the barrier, and an open top, wherein fumes travel through said filter and through said spaces and out said open top.

3. The flash suppressor according to claim 1, further comprising a base for supporting said barrier on a surface, said base having a flat bottom and two side walls that contact the inside and outside walls of the barrier to keep the barrier in place.

4. The flash suppressor according to claim 1, wherein the filter contains activated carbon.

5. The flash suppressor according to claim 1, wherein the barrier is about eighteen inches in height.

6. The flash suppressor according to claim 1, wherein the barrier is made of at least two pieces that fit together around the appliance.

7. The flash suppressor according to claim 1, wherein the barrier is made of galvanized steel.

8. The flash suppressor according to claim 1, further comprising a plurality of vertical ribs disposed between said inside and outside walls to maintain the width of said space.

9. The flash suppressor according to claim 1, wherein the barrier is circular.

10. The flash suppressor according to claim 1, wherein the barrier is rectangular.

11. The flash suppressor according to claim 6, wherein each piece has two ends, each end having a cap to close the space between the inside and outside walls.

12. The flash suppressor according to claim 1, wherein the outside wall has a lower portion and an upper portion, said lower portion being larger in circumference than said upper portion and said filter being disposed in said lower portion, wherein said upper wall has a channel therethrough between said upper portion and lower portion to permit insertion and removal of said filter through said channel.

13. The flash suppressor according to claim 12, further comprising a cap removably positioned over said channel.

14. The flash suppressor according to claim 1, further comprising a cover surrounding the flash suppressor.

15. The flash suppressor according to claim 14, wherein the cover has inlet and exhaust openings to allow air and fumes to enter and exit the flash suppressor.

* * * * *